US005622312A

United States Patent [19]

Martin

[11] Patent Number: 5,622,312

[45] Date of Patent: Apr. 22, 1997

[54] RAIL TRACK SURFACE STRUCTURE

[76] Inventor: John K. Martin, 419 Oakside Circle SW, Calgary, Alberta, Canada, T2V 4V3

[21] Appl. No.: 534,235

[22] Filed: Sep. 26, 1995

[51] Int. Cl.[6] ..... E01B 26/00

[52] U.S. Cl. ..... 238/2; 238/8

[58] Field of Search ..... 238/2, 3, 4, 5, 238/6, 7, 8, 9, 349, 351, 382

[56] References Cited

PUBLICATIONS

*RT&S Track Buyer's Guide*, 1996, pp. 43–47, "Grade Crossing Choices For Different Environments".

*Primary Examiner*—Mark T. Le

*Attorney, Agent, or Firm*—Harold H. Dutton, Jr.; Diane F. Liebman

[57] ABSTRACT

Rail track insert assembly for use between rails and adjacent road surfaces in a road level rail bed comprising resiliently flexible elongate members engaging, respectively, with the rail and the adjacent road surface and defining a generally vertical slip plane at their interface, to accommodate vertical movement of the rail in response to the passage of rail car wheels, while sealing against intrusion of surface water and detritus. An elongated channel defined in the under surface of each of the insert members accommodates rail clips securing the rail to the underlying track bed.

8 Claims, 7 Drawing Sheets

RAIL TRACK SURFACE STRUCTURE

BACKGROUND OF THE INVENTION

The invention relates to rail track surface structures and more particularly to a new and improved rail track surface structure employing resilient closure inserts between each side of the rails and adjacent road surfaces.

In rail track construction, it is frequently necessary to align the rail head with adjacent road surfaces. In heavy weight railway trackage, this occurs at level crossings, where vehicular roadways intersect railway trackage, and in light rail trackage in urban areas where street surfaces are aligned with rail head levels to facilitate pedestrian and vehicular movement.

Rails employed in both railway and light rail urban transport include a base, a vertical web, and a head portion; each pair of rails forming a track having inner sides designated "gauge" sides, facing each other, and outer sides designated "field" sides.

Rail design conventionally employed in railway trackage uses a T-rail section, generally symmetrical in cross-section, in which the flange of the railway wheel laterally engages the gauge side of the head portion of the rail, with no underlying engagement of the flange. However, for light rail transportation such as in typical urban light rail transportation systems, a girder-rail section is being increasingly employed, in which a flangeway is formed integrally in a gauge side lateral extension of the head of the rail, to accommodate the downwardly depending flange of the railcar wheel, the upstanding leg of the rail head so defining the flangeway then engaging the road surface between the rails to accommodate vehicular and pedestrian traffic.

It is with each of these rail designs that the present invention is concerned, as will be apparent as this disclosure proceeds.

Considerable effort and ingenuity has heretofore been displayed to improve rail track surface structures to reduce maintenance at the interface between rail and adjacent road surface.

Degradation of the structure results from water and solid particulate foreign matter ("detritus") intrusion adjacent the rails, which passes downwardly to the rail bed, causing deterioration of the structure and frequent maintenance.

A further problem resulting from unwanted water intrusion into the rail bed results from the breakdown in the electrical insulation normally existing between the metal rail and the ground. In this regard, the rails are frequently employed as conductors of low-voltage currents used in signaling, or in applications of light rail transport in which the locomotive is electrically powered, the rail functioning as a conductor in the power circuit. Negative consequences result in stray currents escaping from the metal into surrounding structures or the ground, when water is permitted to intrude into the rail bed. The problem of water intrusion into the rail bed is further aggravated when dissolved road salts, entrained in the surface water, reach the metal in the rail bed, resulting in costly corrosion.

Conventionally, rail track surface structures have employed resilient electrically nonconductive inserts adapted for insertion in the space defined on both gauge and field sides of the rail members between the rails and the adjacent road surfaces, the purpose of which has been to attempt to seal the adjacent rail members from water and detritus while permitting the use of conventional asphalt materials between and against adjacent rails, on the gauge sides and field sides thereof, respectively. Typical of such level crossing inserts are those shown in U.S. Pat. No. 4,461,421 to Maass; U.S. Pat. No. 4,899,933 to Martin and U.S. Pat. No. 3,469,783 to Uralli, each of which discloses a railway crossing insert of resilient material, resting on the base of the rail, cooperating with the rail on the one side, and interfacing with the adjacent road surface on the other side.

Much of the sealing problem is occasioned by the necessary provision for accommodation of downward flexing of the rail and track bed consequent on the passage of heavy rail loadings from rail traffic. Such deflections are unavoidable and normally are of the order of several millimeters, which movement is largely manifest at the interface between the insert and the adjacent road surface, the insert itself moving with the rail. This rail and insert movement, however, is attendant with negative consequences, due to spalling, crumbling and cracking of the asphalt material on the adjacent road surface where it interfaces with the insert, requiring maintenance and restoration of the road surface.

Other problems in rail track surface structure insert design arise due to the necessity of providing sufficient support to the insert to stand up under automobile and truck traffic passing over the road level railway, causing such seals to break down.

It will be understood by those familiar with modern track construction, and particularly with light urban transit track, that tracks are frequently laid on a rail bed comprising steel track plates laid on concrete slabs, with electrical insulation between the base of the rail and the track plate; heavy robber extrusions are usual for such purpose.

In such rail bed construction, known as "Direct Fixation", the track plates are secured to the concrete slab by electrically insulated hold-down bolts set in the concrete slab; rail clips of the Pandrol (trademark) or similar type, flexibly secure the rail to the track plates underlying the electrical insulation, under downward spring biasing.

Further attention to insert design has been directed to modification of the bottom surface of the insert in order to accommodate such flexible rail clips used to secure the rail to the underlying track plates. Typical of such designs are those shown in U.S. Pat. No. 4,606,498 to Grant and U.S. Pat. No. 4,899,933 to Martin, each of which discloses means of relieving the undersurface of the insert adjacent the rail clips, thereby to form a chamber in order to accommodate the rail clips.

It will be recognized that the rail space between the rail members and the adjacent road surface will, in cross-section, be generally that of a truncated pyramid, having stepped sides, so dictated by the practical considerations of minimizing the width of the rail space at its top surface where exposure to surface traffic occurs, and increasing the width of the rail space at its bottom surface to accommodate the width of the rail base and rail securing clips. This generally truncated pyramidal cross-sectional shape dictates the design of the track surface structure insert assembly.

It is the object of the present invention to address and overcome each of these problems by providing a rail track surface structure for use in Direct Fixation track construction comprising insert members which adapt to both T-rail and girder rails, and accommodate vertical flexing of the rail relative to the adjacent road surface without resulting degradation of the adjacent road surface, while continuing to seal against the intrusion of water and solid detritus into the rail bed.

SUMMARY OF THE INVENTION

Accordingly, the present invention comprises a rail track surface structure insert assembly comprising electrically non-conductive and flexible sealing assemblies for insertion in each of the gauge side and field side of the rail. In a first preferred embodiment, each insert assembly comprises a longitudinally extending first rail insert member sealingly registering with and contoured to fit against the head, web and base of the rail on each of its field side and gauge side; a longitudinally extending second offset insert member operatively interfacing with each of the first rail insert members at a generally vertical slippage plane formed therewith, while sealingly registering and interfacing with the adjacent road surface; and longitudinally extending support means cooperating with and supporting the second offset insert member and registering at its bottom surface with the underlying rail bed.

Each first rail insert member is extruded or moulded to a cross-sectional profile having a rail-engaging surface conforming to the adjacent surface of an adjacent rail, and an outer generally vertical planar surface registering with a corresponding planar surface of a cooperating second offset insert member, thereby defining a slip plane to permit relative movement of the first rail insert member with the second offset insert member consequent on the flexing of the adjacent track rail when under rolling load.

In the first preferred embodiment, the second offset insert member is formed to a cross-sectional profile having a rail side planar surface registering with the corresponding planar surface of the cooperating first rail insert member, and includes a downwardly and outwardly inclined leg portion resting at its bottom end on the rail bed, offset and sloping downwardly away from the adjacent rail, thereby spatially adapting to accommodate the underlying rail clips securing the adjacent rail to the rail bed by forming a chamber defined between the first and second insert members and the rail bed. The second offset insert member may optionally be formed having a significant thickness, of the same resilient material as that used in the first rail insert member, or alternatively may be formed of sheet metal or other relatively thin section material, as will be hereinafter described.

The third support means may optionally comprise a support member extruded or moulded to a cross-sectional profile configured at its upper surface to the underlying surface of the inclined leg portion of the second offset insert member, spatially occupying the volume underlying the downwardly and outwardly extending leg portion of the second offset member and overlying the adjacent rail bed, thereby to maintain the second offset insert member in close registering contact with the adjacent road surface and the cooperating first rail insert member. Alternatively, the support means may be formed integrally with the second offset member as a downwardly depending extension thereof, as will be hereinafter described.

The third support member is longitudinally interrupted at intervals to accommodate the rail clips securing the rail to the track bed on each side of the rail, or is installed in short sections, spanning between adjacent rail clips.

Unlike the prior seals of this type, the present seal assembly provides a sealing system which permits flexing of the rail by accommodating relative movement of the first rail insert member against the second offset insert member along a slip plane defined at their vertical planar interface, without disengagement or relative movement of the second offset insert member with the adjacent road surface while spacially accommodating the underlying rail chips.

In a second preferred embodiment the second offset insert member comprises a panel member in the configuration of a rectangular prism having a planar edge surface registering with the corresponding planar edge surface of the cooperating first rail insert member, thereby to define a slip plane at their generally vertical planar interface in order to accommodate flexing of the rail. Such panel members may be pre-cast, to rest directly on the underlying rail bed, without any additional or third support means, and will form a major portion of the road surface adjacent the rail track.

In a third embodiment specifically intended for rail crossing installations, the slip plane of the second embodiment is modestly canted off vertical, downwardly and outwardly by approximately 5°, thereby to create a wedging action between the first rail insert member and the panel member at the slip plane on rebound of the rail upon its unloading, in order to promote tight engagement of the first rail insert member and the panel member.

BRIEF DESCRIPTION OF THE DRAWINGS

The novel features believed to be characteristic of this invention are set forth with particularity in the appended claims. The invention itself, both as to its organization and understood by reference to the following description taken in connection with the accompanying drawings in which:

DETAILED DESCRIPTION OF THE PREFERRED EMBODIMENTS

Figure 1:
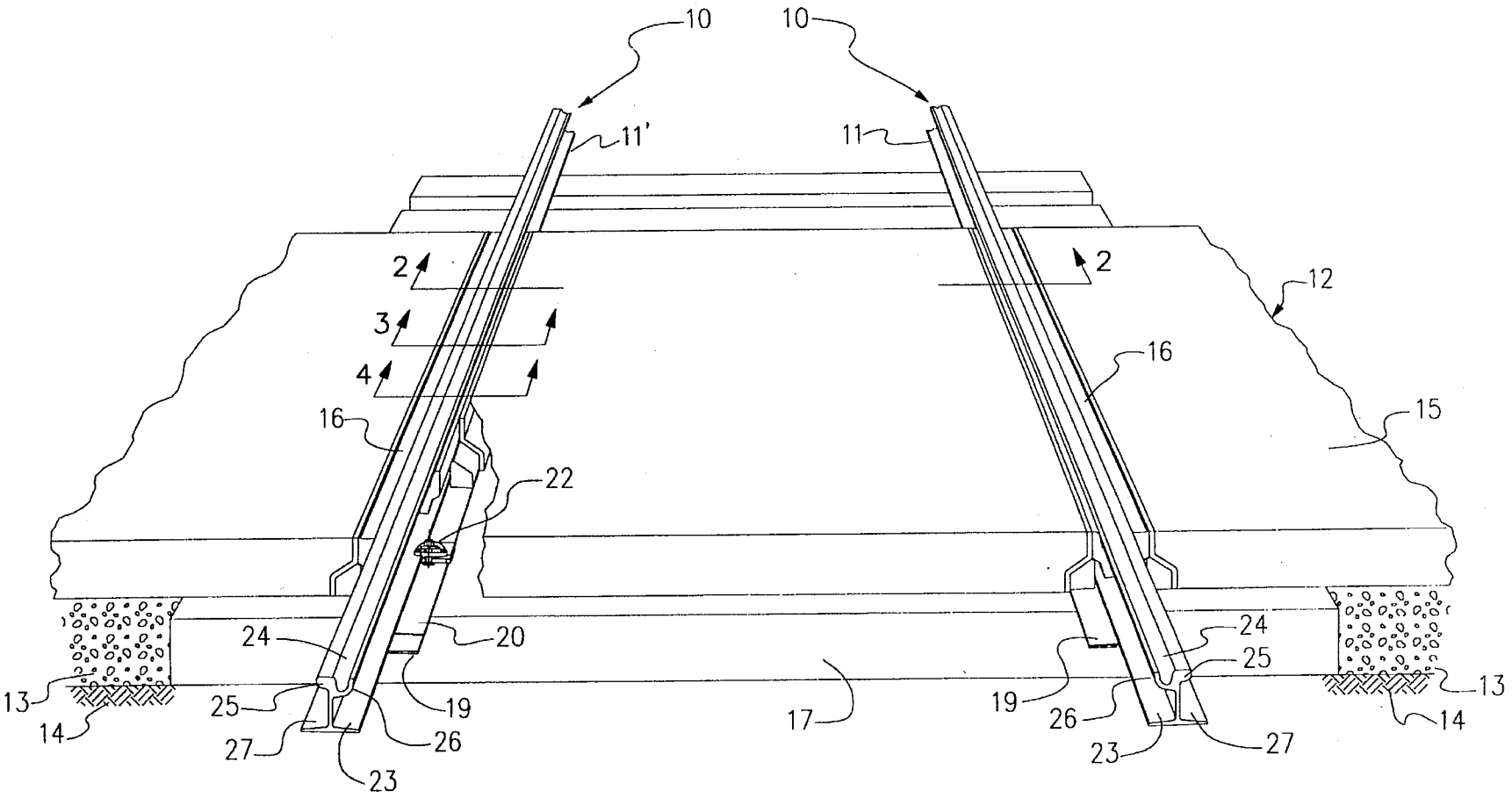
FIG. 1 is a perspective view of a grade crossing according to the first preferred embodiment of this invention, the rails being of girder rail section.

As depicted in FIG. 1, the intersection of a railway track 10, having a pair of steel rails 11, 11' intersects with a vehicular road 12.

The road 12 adjacent the track 10 is normally comprised of a rock base 13 on top of a subgrade 14 and a finish layer 15 which may be asphalt or concrete. Such a road construction abuts the field sides of the rails, FIG. 1, separated therefrom by the gap 16 which accommodates the insert assembly of this invention. Desirably, the road surface will extend as closely as possible towards the adjacent rail, in order to expose the maximum of road surface to vehicular traffic.

Figure 2:
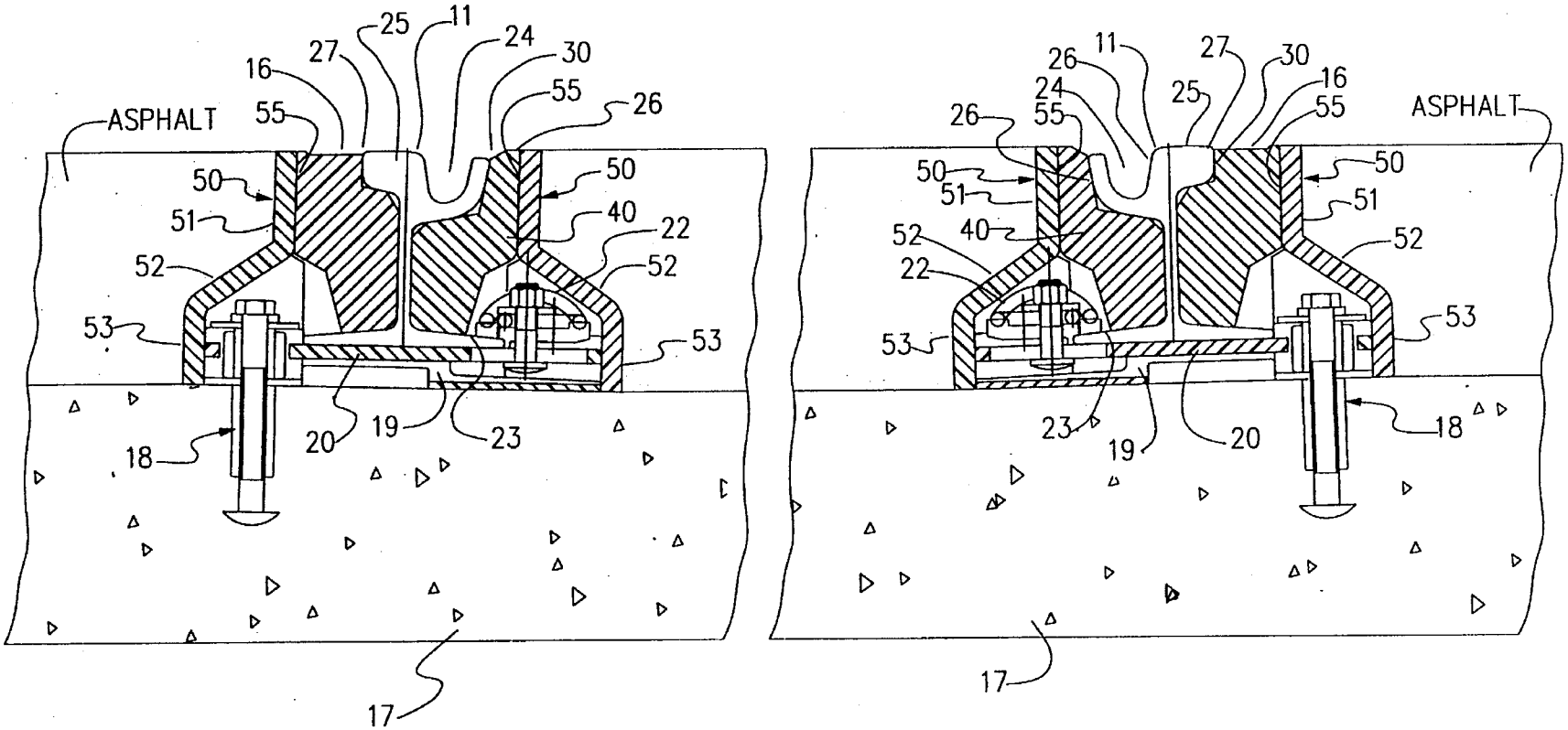
FIG. 2 is an enlarged cross-sectional view in elevation taken along line 2—2 of FIG. 1.
Figure 3:
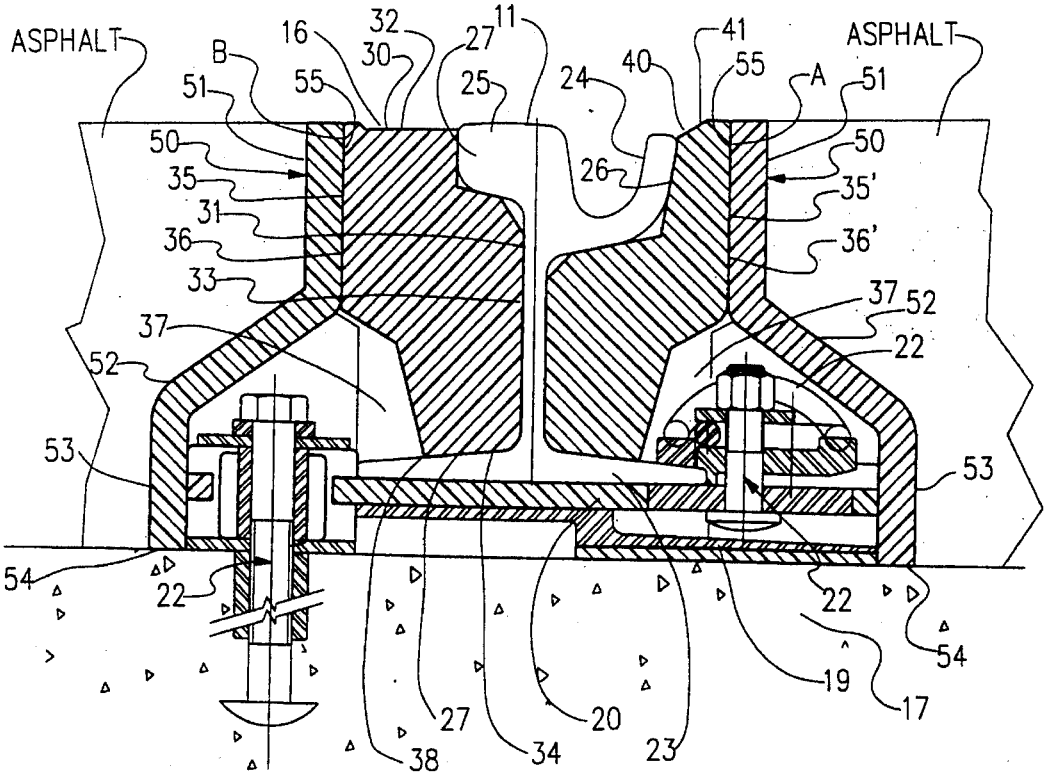
FIG. 3 is a partial enlarged cross-sectional view in elevation taken along line 3—3 of FIG. 1.

Rails 11, 11' are supported on a sub-structure of which the base is concrete ties or a concrete slab depicted at 17, into which are set hold-down bolt assemblies 18, depicted in detail in FIGS. 2 and 3.

Track plates 19, drilled to accommodate the hold-down bolts 18, rest on the concrete slab or ties, 17, and elastomeric pads 20, underlying the bottom flange 23 of the rails 11, 11' electrically insulate the metal rails from the ground. Pandrol (trademark) rail clips 22 secure the rails 11, 11' to the track plates 19 by engagement with the bottom flange 23 of the rails as depicted in FIGS. 2 and 3.

The rails 11, 11' of FIGS. 1, 2 and 3 are of the girder-type, having a flangeway 24 formed on the rail head 25 on its gauge side 26 opposed by its field side 27. It will be understood that the flangeway 24 accommodates the downwardly depending flange of a railway wheel, not shown.

In FIGS. 2 and 3 may be seen the details of the profile of the insert members of a first preferred embodiment of this invention. Proceeding, to describe the insert members in detail, reference will first be made to the pair of insert members abutting the rail, designated 30 and 40 respectively in FIGS. 2 and 3 which are designated herein as first rail insert members, one of which, designated 30, is contoured and dimensioned to abut the field side 27 of the associated rail member, and is referred to in this disclosure as the "field side first rail insert member", and the other of which is designated 40 and is referred to as the "gauge side first rail insert member". The field side first rail insert member 30, is formed having a rail engaging profile 31 on its rail side contoured and dimensioned to bear against the field side 27 of the adjacent rail 11, having a top surface 32, a side surface 33 contoured to fit snugly against the field side of the rail 11, and a bottom surface 34 contoured to rest on the horizontally extending bottom flange 23 of the rail.

The gauge side first rail insert member 40 is similarly profiled on its rail side to bear against the outwardly extending flangeway on the gauge side of the rail, as depicted in FIG. 3.

The field side 35 of the field side first rail insert member 30 and the gauge side 35 of the gauge side first rail insert member 40 are each provided with a planar vertical surface 36, 36' respectively in FIGS. 2 and 3, which engages with a registering surface of the second offset insert member, as will be hereinafter explained, as this description proceeds.

A recess 37, formed on the lower outside corner 38 of each of the first rail insert members 30, 40, forms a longitudinal channel in the first rail insert member to accommodate the rail clip 22, FIGS. 2 and 3 in overlying relationship.

The gauge side first rail insert member 40, FIGS. 2 and 3 is contoured and dimensioned at its top surface 41 to register with the outwardly extending flange 24 on the gauge side 26 of the rail 11. Otherwise, the flange side first rail insert member 40 in the embodiment for usage with the girder rail, is a mirror image in cross-section to the field side first rail insert member 30, FIGS. 2 and 3, heretofore described in detail.

Figure 6:
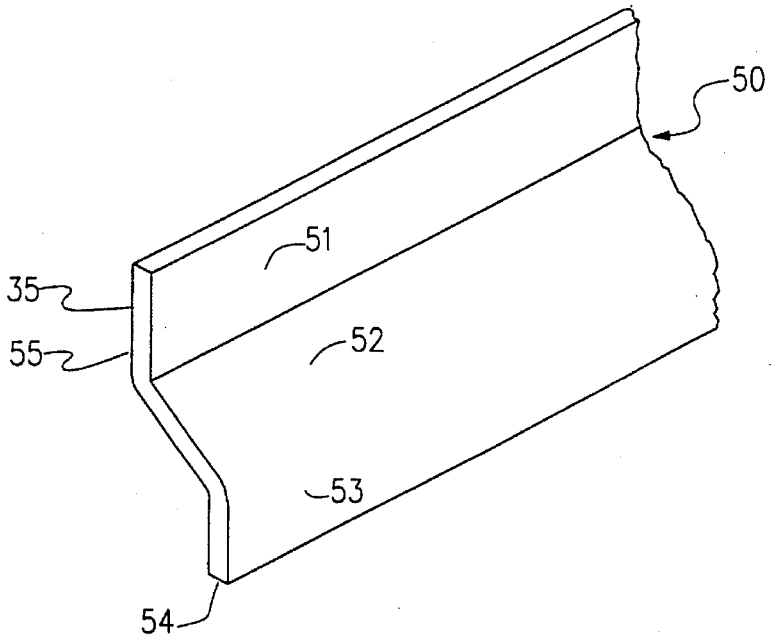
FIG. 6 is a perspective view of a second offset insert member for use in the structure depicted in FIGS. 1 through 4.

Turning now to a description of the second offset insert member of the first preferred embodiment of this invention, generally designated at 50, FIGS. 2, 3 and 6, this comprises a longitudinally-extending member having in cross-section, an upper vertical leg, 51, a downwardly and outwardly inclined intermediate leg 52 and a bottom generally vertical leg 53, formed in continuous section to provide a relatively thin-walled insert member to register with the adjacent road surface material such as the asphalt as depicted in FIGS. 1, 2 and 3. The offset of the bottom vertical leg 53, compared to the upper vertical leg 51, will be such as to accommodate the rail clip 22 in cooperation with the recess 37 of the field side of the first insert member 30 and the gauge side of the first rail insert member 40 by defining a longitudinally-extending channel therefor, as described. At its lower extremity 54, the second offset insert member 50 rests on the rail tie or rail bed slab 17, as depicted in FIGS. 2 and 3, and at its rail-facing vertical planar surface 55 will register in closely engaging interfacing relationship with the planar vertical. surface 36 of the first rail insert members 30 and 40, FIGS. 2 and 3, respectively, to define slippage planes A and B, again respectively, FIG. 3.

Figure 4:
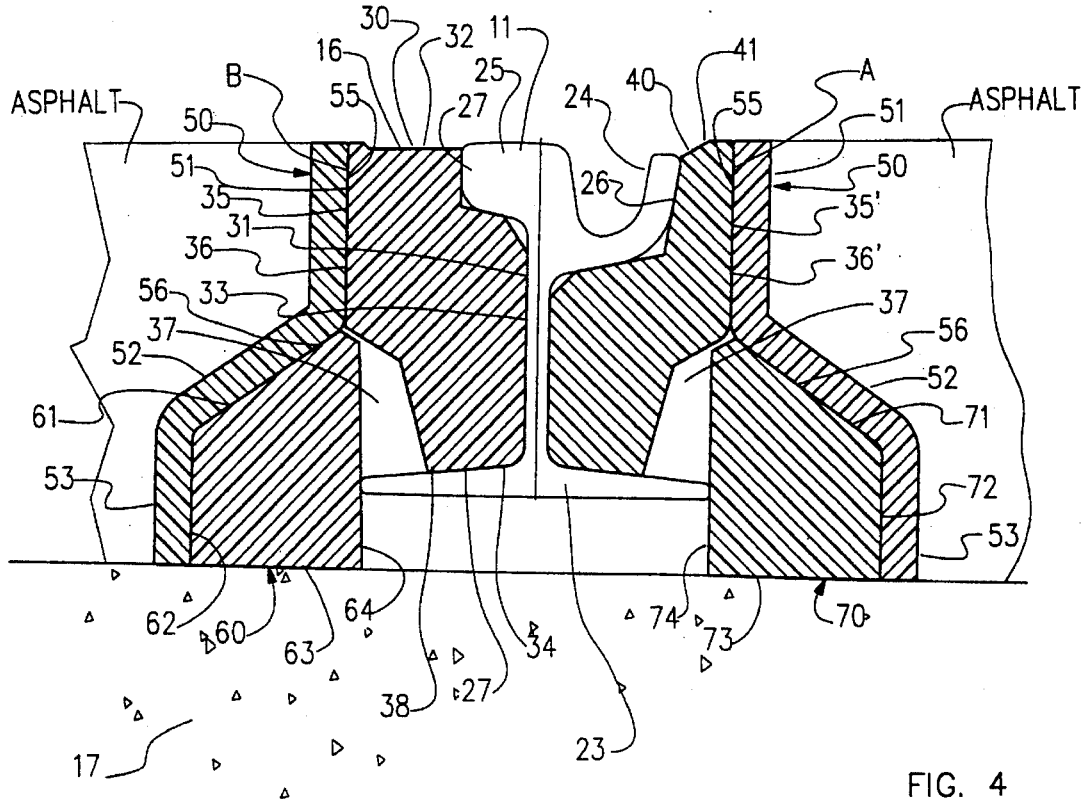
FIG. 4 is a partial enlarged cross-sectional view in elevation taken along line 4—4 of FIG. 1.

Now turning to a description of the third support insert member of the first preferred embodiment of this invention, reference to FIG. 4 depicts a pair of trapezoidal cross-sections, 60 and 70, being identical in mirror image, having a downwardly inclined upper surface 61, 71, respectively, registering with the undersurface 56 of the second offset insert member 50, as depicted in FIG.4, thereby to afford underlying support thereto against the downward loading from the asphalt road material and surface vehicular traffic load applied to the upper extremity of the second offset insert member 50. A generally vertical downwardly extending planar edge 62, 72, respectively, registers with the adjacent bottom vertical leg 53 of the second offset insert member 50, to provide lateral support thereto. A bottom planar surface 63, 73 respectively, rests on the underlying concrete tie or slab 17, as depicted in FIG. 4, and a generally vertical planar inner face 64, 74 respectively, abuts the outer edges of the track plate 19 and bottom flange of the track.

Figure 8:
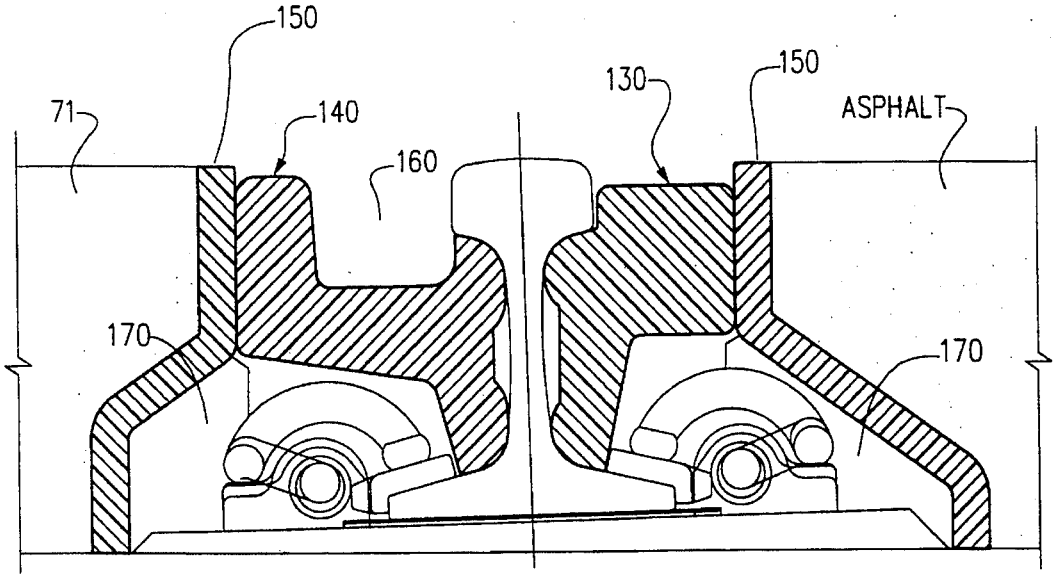
FIG. 8 is an enlarged partial cross-sectional view in elevation depicting the insert assemblies of this invention used with a T-rail.

Having thus described the insert members of the first preferred embodiment of this invention designed for a girder-type rail, attention will now be directed to a similar type of assembly for a T-type rail, for which reference is made to FIG. 8. Since the T-rail is symmetrical in cross-section, the first rail insert members generally designated 130, 140, and the second offset insert member 150, and the third support insert member 160, respectively, heretofore described in detail, will be similar in mirror image on the field side and the gauge side, except for the gauge recess 170, formed on the gauge side of the first rail insert member 140 to accommodate the wheel flange of a rail car, not depicted.

Figure 4A:
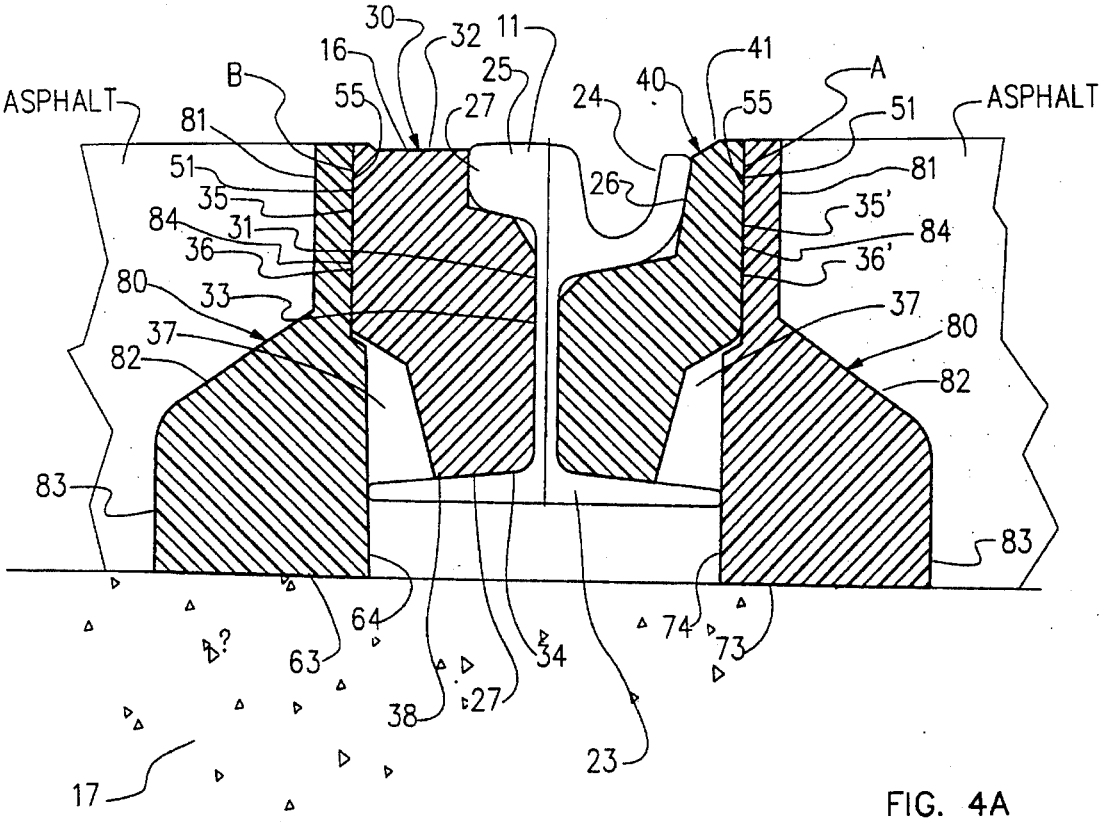
FIG. 4A is a perspective view of an alternative construction in which the second offset insert member is formed integrally with the third support insert member.

In an alternative construction of the first preferred embodiment for this invention, the third support members 60, 70 of FIG. 4 are each formed integrally with the related second offset insert member, as depicted at 80 in FIG. 4A. This integrally formed member comprises an upper vertical leg 81, a downwardly and outwardly inclined road-supporting surface 82 and a downwardly extending lower portion 83 resting on the rail tie or road bed slab 17. At its rail-facing vertical planar surface 84, the member 80 will register in closely engaging interfacing relationship with the planar vertical surface 36, 36' of each of the first rail insert members 30, 40 to define the slippage planes A and B, as heretofore described. In this alternative construction, assembly on-site is simplified in the elimination of a third member of the three separate insert components heretofore described, but on-site notching of the rail-facing sides of the member 80 may be required at its lower extremity in order to accommodate the rail clips 22, FIGS. 2 and 3. In contrast, the third support members 60 and 70, FIG. 4 in the first alternative embodiment are supplied in short lengths spanning between adjacent rail clips.

Figure 5:
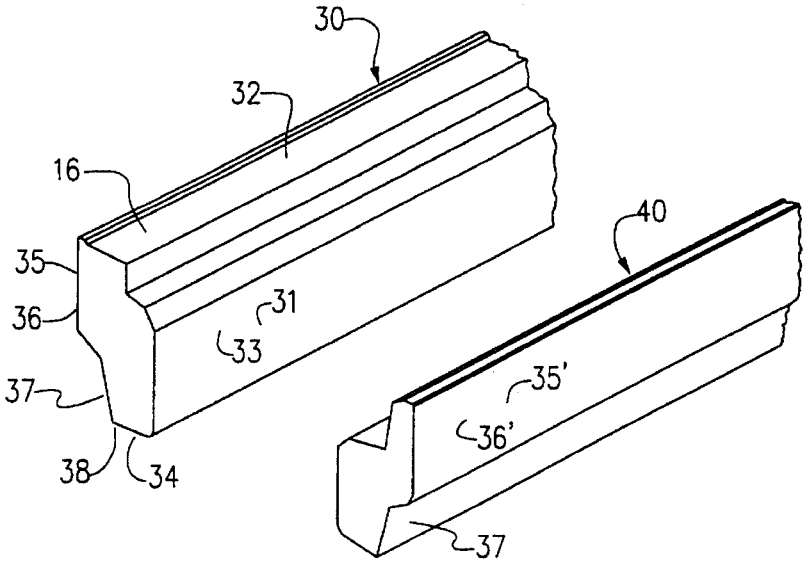
FIG. 5 is a perspective view of the first rail insert members for use in the structure depicted in FIGS. 1 through 4.
Figure 7:
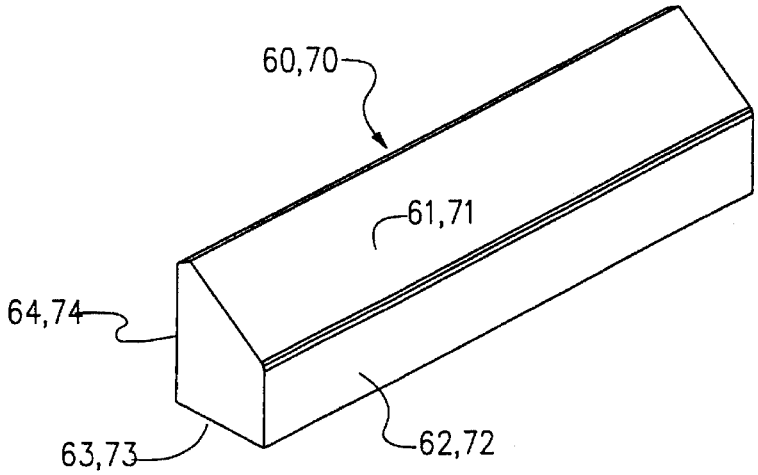
FIG. 7 is a perspective view of a third support insert member for use in the structure depicted in FIGS. 1 through 4.

The first rail insert member 30, 40; the second offset insert member 50 and the third support insert member 60, 70, are each depicted in perspective in FIGS. 5, 6 and 7 respectively.

The insert members are desirably extruded from a thermosetting mix of recycled rubber crumb and polyurethane resins.

In installation of the first alternative construction, each first rail insert member is positioned against the corresponding surface of the associated rail 11, 11', following which third support insert members are positioned between members of each pair of rail clips 22, and the sequence is completed by installation of the second offset insert member 50 in overlying relationship with the third support insert member and in edge-abutting relationship with the first rail insert member, as depicted in FIGS. 2, 3, 4 and 8. The road surfacing material 15 is then placed snugly against the second offset insert member 50, compressing its interfacing engagement at its vertical planar surface with the vertical planar surface 36, of the registering first rail insert member. The upper surface of the first rail insert member, the upper surface of the second offset insert member and the adjacent asphalt road surface on each of the field side and the flange side of the rail are substantially even and level with the upper surface of the rail head 11 so as to present a uniform surface to vehicles and pedestrian traffic.

Downward deflection of the rails 11, 11' resulting from railway car loading will be accommodated by slippage movement of the planar surface 36 of the rail insert members 30, 40 against the associated and registering planar surfaces of the adjacent second offset insert members 50 at the slip planes A and B, FIGS. 3 and 4. Subsequent unloading of the rail following passage of the railway car, permits the realignment of the first rail insert members at their upper surfaces in level engagement with the upper surface of the second offset insert members.

Thus, with the assembly of this invention as depicted and described in the first preferred embodiment, vertical deflection movement of the rail is confined to the interface between the first rail insert member and the second offset insert member, rather than the interface with the adjacent road surface. In this manner, the likelihood of crumbling, cracking and spalling of the road surface at its rail-facing edge is minimized or eliminated.

The close engagement of the planar edge surface of the first rail insert members with the corresponding planar edge surface of the associated second offset insert members, prevents the intrusion of water and detritus into the underlying rail bed.

Figure 9:
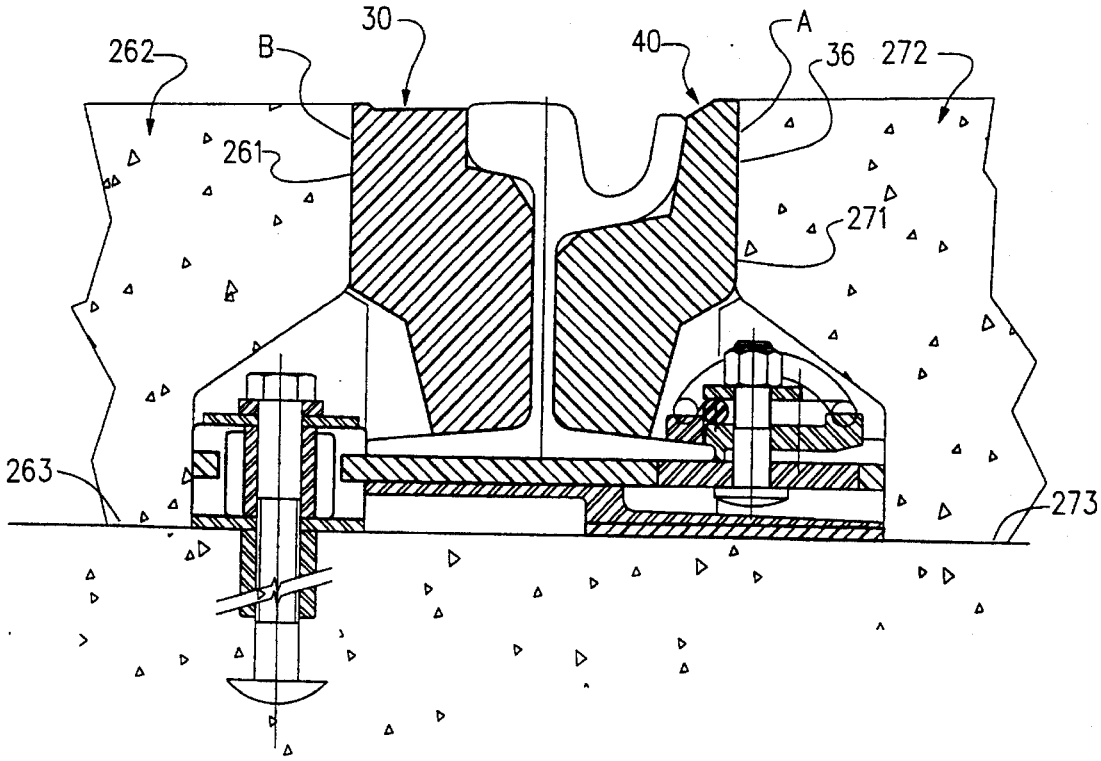
FIG. 9 is a cross-sectional view in elevation of the second preferred embodiment of the invention.

In a second preferred embodiment of the invention, depicted in FIG. 9, the first rail insert members 30, 40, interface at their respective planar vertical faces 36 with the planar vertical faces 261, 271 of a pair of road surface panels generally designated 262, 272 respectively, thereby defining the vertical slip planes designated A and B accommodating flexing movement of the rails and the cooperating first rail insert members 30, 40, FIG. 9. Each of the road surface panel members 262, 272 will provide a major portion of the track road surface, and is configured at its inward rail-facing edge in profile generally similar to the profile of the inward rail-facing edge of the second offset insert members 50, FIG. 2, above described in detail.

At their bottom surfaces 263, 273, the panels rest on the rail bed slab, as depicted in FIG. 9.

It will be understood that in order to permit free flexing movement of the first rail insert members 30, 40, relative to and against the road surface panels, the planar generally vertical faces of the panels must present a relatively smooth non-frangible surface at the slip planes A and B, FIG. 9.

Figure 10:
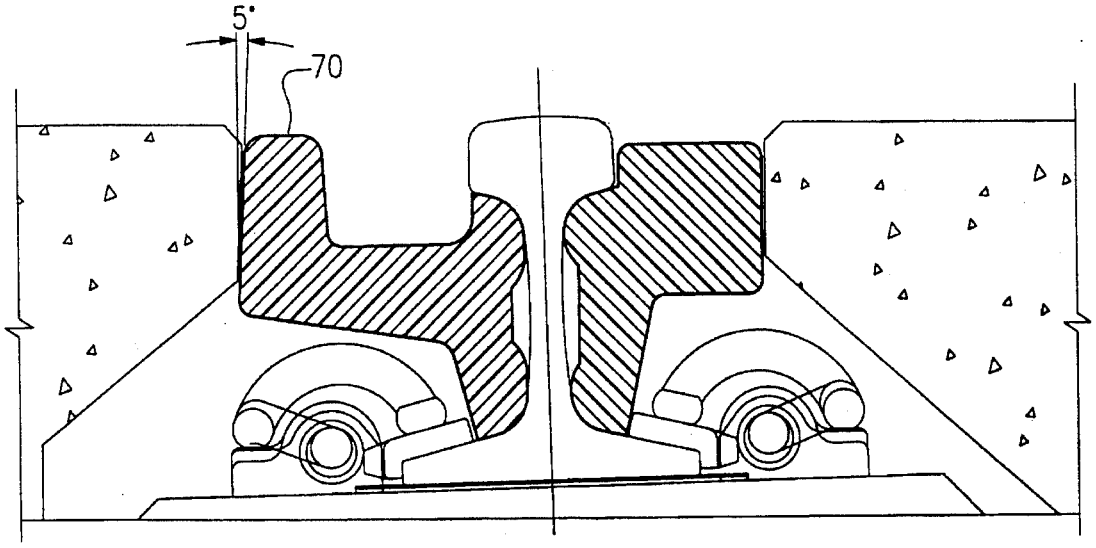
FIG. 10 is a partial enlarged cross-sectional view in elevation corresponding to the view of FIG. 3, depicting the third embodiment of the invention, in use with a T-rail and with precast panel.

In a modification of the road surface panel depicted in FIG.9, the generally vertical slip planes on the gauge sides of each of the rails 11, 11', are inclined downwardly and outwardly away from the adjacent rail at an angle of approximately 5° to the vertical, as depicted in FIG. 10, thereby to create a wedging action between the panel member and the adjacent first rail insert member 70, during installation and also upon rebound of the rail and first rail insert member following passage of the train and the consequent unloading of the rail. This wedging action functions to promote tight engagement of the first rail insert member with the adjacent stationary panel between the rails 11, 11', which is enhanced during installation of the structure by horizontal compression of the first rail insert member against the adjacent rail.

In this modification, which is intended for railcrossing installations, the generally vertical configuration of the slip planes B, FIGS. 2 and 3, will normally be maintained on the field sides of each of the rails 11, 11', in order to better accomodate vertical movement between the rail and field side roadway.

The road surface panels, of convenient rectangular configuration, may be either preformed of concrete, or of poured-in-place concrete with suitable concrete forms to define the rail-facing edge surfaces described, and may be installed in rail trackage on the gauge side of each rail between members of a pair of rails or on the field side of rail members.

The rail insert members may be readily and economically formed by extrusion of comminuted used rubber stock obtained from discarded automobile tires, producing an elastomeric material having a Shore durometer rating of between about 65 and 70. Other non-rigid high molecular weight materials may alternatively be used, such as polyurethane, having good impact strength and resistance to abrasion, low coefficient of thermal expansion and chemical resistance, with high electrical insulating properties.

It will, of course, be understood that the insert assembly of this invention has application in both rail level grade crossings and in urban installation of light rail transit, where extensive sections of track are laid in street surfaces also used by motor vehicle and pedestrian traffic.

While the invention has been described with respect to certain specific embodiments, it will be appreciated that many modifications and changes may be made by those skilled in the art without departing from the spirit of the invention. It is intended, therefore, by the appended claims to cover such modifications and changes as fall within the true spirit and scope of the invention.

I claim:

1. A rail track surface structure insert assembly for use in the space defined between a track rail and an adjacent road surface, wherein said rail is secured to a rail bed by rail clips, and comprises a rail head, rail base and an intermediate web connecting said rail head and the rail base and having a gauge side and a field side, said insert assembly comprising, in combination:

a longitudinally extending first rail insert member having a top surface, a bottom surface, a rail-engaging side surface and an opposite side surface, said top surface adapted to lie in the general plane of the top surface of said rail head; said bottom surface sealingly registering with the upper surface of the base of said rail; said rail engaging side surface contoured to sealingly register on a major portion thereof with said web of said rail and on a minor portion thereof to sealingly register with the side of the head of said rail; said opposite side surface including a generally vertical planar surface when the first rail insert member is installed in registering contact with said rail;

a longitudinally extending second insert member having a top surface, a bottom surface, a road surface-engaging side surface and an opposite side surface, said top surface adapted to lie in said general plane of the top surface of said rail head when installed in registering contact with said first rail insert member; said bottom surface sealingly registering with the underlying rail bed; said road surface-engaging side surface adapted to fixedly and sealingly register with said adjacent road surface; and said opposite side surface including a vertical planar surface adapted to sealingly register with said vertical planar surface of said first rail insert member, thereby to provide a slip plane to accommodate relative movement of said first rail insert member with said second insert member consequent on the vertical flexing movement of said first rail insert member and said adjacent track rail in fixed registration therewith.

2. The rail track surface structure insert assembly of claim 1 for use with a girder rail having a laterally extending rail car wheel flange wherein the gauge side of the gauge side first rail insert member is recessed to accommodate the laterally extending flange on said rail.

3. The rail track surface structure insert assembly of claim 1 in which the bottom surface of each of said first rail insert member and said second insert member is recessed to define a longitudinally extending chamber adapted to accommodate the rail clips securing the rail to the rail bed when said first and second insert members are installed in the space defined between the track rail and adjacent road surfaces.

4. A rail track surface structure insert assembly for use in the space defined between a track rail and an adjacent road surface, wherein said rail is secured to a rail bed by rail clips, and comprises a rail head, rail base, and an intermediate web connecting said rail head and the rail base and having a gauge side and a field side, said insert assembly comprising, in combination:

a longitudinally extending first rail insert member having a top surface, a bottom surface, a rail-engaging side surface and an opposite side surface, said top surface adapted to lie in the general plane of the top surface of said rail head; said bottom surface sealingly registering with the upper surface of the base of said rail; said rail-engaging side surface contoured to sealingly register on a major portion thereof with said web of said rail and on a minor portion thereof to sealingly register with the side of the head of said rail; said opposite side surface including a generally vertical planar surface when the first rail insert member is installed in registering contact with said rail;

a longitudinally extending second offset insert member adapted to co-operate and interface with said first rail insert member and fixedly to register with the adjacent road surface, including:

a top surface adapted to lie in the general plane of the top surface of the rail head;

a road surface-engaging side surface adapted fixedly and sealingly to register with said adjacent road surface;

an opposite side surface including a vertical planar surface adapted to sealingly and snugly register with said vertical planar surface of said first rail insert member;

a bottom surface adapted to sealingly rest on the underlying rail bed; said second offset insert member including offset means whereby an inclined lower portion of said second offset insert member inclines downwardly and outwardly from said rail when installed in said space in order to define a longitudinally extending space adapted to accommodate a plurality of rail clips securing the rail to the rail bed;

a longitudinally extending third support insert member adapted to support said second offset insert member in sealing registration with said adjacent road surface when said third support member is installed on the underlying road bed in the space defined between the track rail and the adjacent road surface, including recess means defining a space to accommodate said rail clips securing the rail to the rail bed.

5. A rail track surface structure insert assembly as in claim 3 in which the third support insert member is formed integrally with the second insert member.

6. A rail track surface structure of a rail track comprising a pair of rails supported by and secured by rail clips to an underlying rail bed, each of said rails having an inwardly facing gauge side and an outwardly facing field side and a rail head, a base and an interconnecting web; an adjacent road surface on each of said field sides of said rails and an intermediate flange side road surface spanning between the gauge sides of said rails, all generally level with the plane of the top of said pair of rails; a space defined between each of the field side and the gauge side of each of said rails and the adjacent road surfaces; the rail track surface structure comprising, on each side of each of said rails, in combination:

a longitudinally extending first rail insert member having a top surface lying in the plane of the top of said pair of rails; a bottom surface sealingly registering with the upper surface of the base of said rail; a rail-engaging side contoured to sealingly register with the side of the head of said rail; and an opposite side surface including a generally vertical planar surface when the first rail insert member is installed in registering contact with said rail;

a longitudinally extending second offset insert member for co-operating and interfacing with said first rail insert member and fixedly registering with the adjacent road surface, including:

a top surface for lying in the general plane of the top surface of the rail head;

a road surface-engaging side surface fixedly and sealingly, registering with said adjacent road surface;

an opposite side surface including a vertical planar surface sealingly and snugly registering with said vertical planar surface of said first rail insert member;

a bottom surface sealingly resting on the underlying rail bed;

said second offset insert member including offset means whereby an inclined lower portion of said second offset insert member inclines downwardly and outwardly from said rail when installed in said space in order to define a longitudinally extending space to accommodate a plurality of rail clips securing the rail to the rail bed;

a longitudinally extending third support insert member supporting said second offset insert member in sealing registration with said adjacent road surface when said third support member is installed on the underlying road bed in the space defined between the track rail and the adjacent road surface, including recess means defining a space to accommodate said rail clips securing the rail to the rail bed.

7. A rail track surface structure insert assembly on a rail bed wherein each of two rails defining a track are mounted on the rail bed between adjacent road surfaces each having rail-facing edges and wherein each of said rails is secured to the rail bed by rail clips and comprises a rail head, rail base and an intermediate web connecting said rail head and the rail base and having a gauge side and a field side, the insert assembly comprising in combination:

a first rail insert member extending longitudinally along the gauge side and the field side of each rail, each first rail insert member having a top surface, a bottom surface, a rail-engaging side surface and an opposite side surface, said top surface lying in the general plane of the top surface of said rail head; said bottom surface sealingly registering with the upper surface of the base of said rail; said rail-engaging side surface contoured to sealingly register on a major portion thereof with said web of said rail and on a minor portion thereof to sealingly register with the side of the head of said rail; said opposite side surface including a generally vertical planar surface when the first rail insert member is installed in registering contact with said rail;

a second rail insert member extending longitudinally along the rail-facing edge of each of said adjacent road surfaces, each second rail insert member having a top surface, a bottom surface, a road surface-engaging side surface and an opposite side surface, said top surface lying in the general plane of the top surface of said rail head when installed in registering contact with said first rail insert member; said bottom surface sealingly registering with the underlying rail bed; said road surface-engaging side surface fixedly and sealingly registering with said adjacent road surface; and said opposite side surface including a vertical planar surface to sealingly registering with said vertical planar surface of said first rail insert member, thereby to provide a slip plane to accommodate relative movement of said first rail insert member with said second insert member consequent on the vertical flexing movement of said first rail insert member and said adjacent track rail in fixed registration therewith.

8. In a rail track surface structure for use with a rail track comprising a pair of rails supported by and secured by rail clips to an underlying rail bed, each of said rails having an inwardly facing gauge side and an outwardly facing field side and a rail head, a base and an interconnecting web; an adjacent road surface on each of said field sides of said rails and an intermediate gauge side road surface spanning between the gauge sides of said rails, all generally level with the top of said pair of rails; a space defined between each of the field side and the gauge side of each of said rails and the adjacent road surfaces; the rail track surface structure comprising, on each side of each of said rails, in combination:

a longitudinally extending first rail insert member having a top surface lying in the plane of the top of said pair of rails; a bottom surface sealingly registering with the upper surface of the base of said rail; a rail-engaging side contoured to sealingly register with the side of the head of said rail; and an opposite side surface including a generally vertical planar surface when the first rail insert member is installed in registering contact with said rail;

a longitudinally extending second rail insert member having a top surface, a bottom surface, a road surface-engaging side surface and an opposite side surface, said top surface adapted to lie in said general plane of the top surface of said pair of rails when the first rail insert member is installed in registering contact with said first rail insert member; said bottom surface sealingly registering with the underlying rail bed said road surface-engaging side surface adapted to fixedly and sealingly register with said adjacent road surface; and said opposite side surface including a vertical planar surface adapted to sealingly register with said vertical planar surface of said first rail insert member, thereby to provide a slip plane to accommodate relative movement of said first rail insert member with said second rail insert member and said adjacent rail in fixed registration therewith.

* * * * *